US010935294B1

(12) United States Patent
Li et al.

(10) Patent No.: US 10,935,294 B1
(45) Date of Patent: Mar. 2, 2021

(54) BOTTLE WITH AN ICE CUBE MOULD

(71) Applicant: Ningbo Vacane Household Commodities Co., Ltd., Ningbo (CN)

(72) Inventors: Chenning Li, Ningbo (CN); Haidong Hu, Ningbo (CN)

(73) Assignee: Ningbo Vacane Household Commodities Co., Ltd., Ningbo (CN)

( * ) Notice: Subject to any disclaimer, the term of this patent is extended or adjusted under 35 U.S.C. 154(b) by 0 days.

(21) Appl. No.: 16/930,871

(22) Filed: Jul. 16, 2020

(30) Foreign Application Priority Data

Apr. 21, 2020 (CN) ..... 202010318672.2

(51) Int. Cl.
*F25C 1/22* (2018.01)
*F25C 1/06* (2006.01)

(52) U.S. Cl.
CPC . *F25C 1/22* (2013.01); *F25C 1/06* (2013.01)

(58) Field of Classification Search
CPC .... F25C 1/22; F25C 1/24; F25C 1/243; F25C 1/246; F25C 1/06; A23G 9/221
See application file for complete search history.

(56) References Cited

U.S. PATENT DOCUMENTS 2,083,081 A * 6/1937 Moll ..... A23G 9/083 249/120
4,804,083 A * 2/1989 Weeks ..... F25C 1/243 206/216
D348,473 S * 7/1994 Griffin, Sr. ..... D15/90
6,345,802 B2 * 2/2002 Moore ..... F25C 1/22 249/117
2007/0107447 A1 * 5/2007 Langlotz ..... F25C 1/243 62/66
2017/0363338 A1 * 12/2017 Jensen ..... F25C 5/04

* cited by examiner

*Primary Examiner* — Cassey D Bauer
(74) *Attorney, Agent, or Firm* — Wang Law Firm, Inc.

(57) ABSTRACT

A bottle with an ice cube mould, comprises a bottle body (1) with a neck (111) and a lid (2), the bottle body (1) has two ice-making plates (3) opposite with each other, at least one of the two ice-making plates (3) has a plurality of recesses (31), and the two ice-making plates (3) are capable of moving relative to each other; when the two ice-making plates (3) are at the closed state, two recesses facing each other (31) form an ice-making space, and a water flow channel for guiding water coming from the water inlet (32) to the ice-making space is formed between the two ice-making plates (3); when the two ice-making plates (3) are at the opened state, a chamber (A) of the bottle body (1) is defined between the two ice-making plates (3), and ice cubes formed inside the recesses drop into the chamber (A) of the bottle body (1). The bottle has both an ice-making function and a water-containing function, and it is sanitary to make ice cubes and also convenient to take the ice cubes out.

9 Claims, 7 Drawing Sheets

BOTTLE WITH AN ICE CUBE MOULD

TECHNICAL FIELD OF THE INVENTION

The present invention relates to a bottle and in particular to a bottle with an ice cube mould.

BACKGROUND OF THE INVENTION

An ice cube mould is a small mold for making ice cubes in the freezer compartment of a refrigerator. A common ice cube mould comprises a box with a plurality of recessed grids thereon. Some ice cube mould may be provided with a lid to cover the grids. During the ice-making, cold water is poured in the grids; the lid is put on; and then the box is put into the refrigerator. When the cold water in the grids becomes ice cubes, the box is taken out of the refrigerator and knocked until the ice cubes fall out of the grids. For example, Chinese patent CN209706394U "ICE-MAKING BOX WITH HIGH PLACEMENT STABILITY" disclosed such an ice cube mould structure.

The existing ice cube mould have the following defects: 1. It is inconvenient to take ice cubes out of the ice cube mould. An extra container must be used to contain the ice cubes falling out of the ice cube mould Furthermore, the splashing of ice cubes may occur during the knocking process. It is unsanitary. 2. In addition, the existing ice cube mould only have an ice-making function.

SUMMARY OF THE INVENTION

A technical problem to be solved in the present invention is to provide a bottle with an ice cube mould function, which has both an ice-making function and a water-containing function. As further advantages of the bottle, it is sanitary to make ice cubes and also convenient to take the ice cubes out.

To solve the technical problem, the bottle with an ice cube mould, comprises a bottle body with a neck; a lid disposed on the neck; wherein, the bottle body has two ice-making plates opposite with each other, at least one of the two ice-making plates has a plurality of recesses; and the two ice-making plates are capable of moving relative to each other, the two ice-making plates facing each other is defined as a closed state, the two ice-making plates spaced apart from each other is defined as an opened state; when the two ice-making plates are at the closed state, two recesses facing each other form an ice-making space, a water inlet in communication with the neck is formed on between the two ice-making plates, and a water flow channel for guiding water coming from the water inlet to the ice-making space is formed between the two ice-making plates; when the two ice-making plates are at the opened state, a chamber of the bottle body is defined between the two ice-making plates, and ice cubes formed inside the recesses drop into the chamber of the bottle body.

Preferably, each ice-making plate has a plurality of recesses, and each recess on one ice-making plates faces to the corresponding recess on another ice-making plate; when the two ice-making plates are at the closed state, the recess on one ice-making plate and the corresponding recess on another ice-making plate form the ice-making space. To make ice cubes that are the same in size, the depth of the grids on one ice-making plate may be reduced. Meanwhile, when the two ice-making plates are opened, the ice cubes can fall out of the grids even the ice cube mould is not knocked. It is convenient to take the ice cubes out.

Preferably, the recesses on each ice-making plate are arranged in several spaced-apart rows, with a plurality of spaced-apart recesses up and down in each row; the water flow channel comprises a recessed upper water chamber formed in a top of the ice-making plate; and the upper water chamber is communicated with the neck, each ice-making plate has multiple connecting channels between the upper water chamber and the topmost recess in each row, and between adjacent two recesses in each row to be communicated up and down. By the arrangement of the upper water chamber, the flowing of sufficient water into each grid is ensured, water can flow into the water chambers faster, and the overflow of water from the neck during water feeding is avoided. Furthermore, only the grids in a same row are communicated to each other, the number of connecting channels used is reduced as much as possible. The formed ice cubes are well separated from each other.

Preferably, the water flow channel further comprises a recessed lower water chamber formed in a bottom of the ice-making plate; and each ice-making plate has a connecting channel between the lower water chamber and the bottommost recess in each row to be communicated up and down. Due to the arrangement of the lower water chamber, the overall amount of water between the two ice-making plates is greater than the volume of the grids. Therefore, the flowing of sufficient water into each grid can be further ensured.

Preferably, each ice-making plate has a gap on the top of the ice-making plate, which is communicated with the upper water chamber, when the two ice-making plates are at a closed state, the two gaps together form the water inlet. This structure ensures a water inlet that is wide enough, and also avoids the formation of the water inlet completely on one ice-making plate.

The ice-making plates can be opened by great effort, since there is a great suction force between the two ice-making plates after the formation of ice cubes between the ice-making plates. To open the ice-making plates easily, at least one of the two ice-making plates has a handle disposed on an external surface of the ice-making plate, for pulling the ice-making plate outward.

Preferably, the bottle body has an annular peripheral frame with two sides, the neck is disposed on the top of the peripheral frame; the peripheral frame surrounds the two ice-making plates, the edge of each ice-making plate is connected to the peripheral frame by a flexible connection wall. The peripheral frame may be made of a hard material, to ensure that the bottle has enough strength. In addition, since the ice-making plates are placed in the peripheral frame and connected to the peripheral frame by the flexible connection walls, the opening or closing of the ice-making plates will not be influenced. Meanwhile, when the flexible connection walls are recessed, the flexible connection walls can generate an elastic force that moves an ice-making plate toward the other ice-making plate, to ensure that the two ice-making plates are kept in a trend of closing; and when the flexible connection walls are protruded, the flexible connection walls can generate an elastic force that moves an ice-making plate away from the other ice-making plate, to ensure that the two ice-making plates are kept in a trend of opening. This avoids the easy deformation of the bottle.

Preferably, each ice-making plate and each flexible connection wall are molded together by secondary injection molding; and a connection ring made of plastic is connected with the outer edge of each flexible connection wall by secondary injection molding, each connection ring and the edge of each side of the peripheral frame are sealed connected with each other. This can ensure firm connection between the ice-making plates and the flexible connection walls. The flexible connection walls are connected to the peripheral frame via the connection ring by physical connection. It is advantageous for assembly.

To avoid losing the lid, the lid is connected to the surface of the peripheral frame via a connection strip.

To drink water conveniently, the neck protrudes upward, and the lid is stuffed into the neck and fully fills the neck. This can avoid ice forming in the neck in the process of making ice.

Compared with the prior art, the present invention provides the bottle with an ice-making function by the arrangement of two ice-making plates. During ice-making, the two ice-making plates are closed and kept in the closed state, and cold water is poured into the neck. The water flows through the water inlet and the water flow channel and into the ice-making spaces. Then, the lid is put on. The bottle is placed in the freezer compartment of the refrigerator. After the water in the ice-making spaces freezes, the bottle is taken out of the refrigerator. An external force is applied to the two ice-making plates to separate them. The cavity of the bottle is formed between the two ice-making plates. The ice cubes in the ice-making spaces fall into the cavity of the bottle body. When in use, the ice cubes may be poured into a cup from the neck, or drinks may be directly injected into the bottle to make iced drinks. The user can drink directly by the neck.

DETAILED DESCRIPTION OF THE INVENTION

Figure 1:
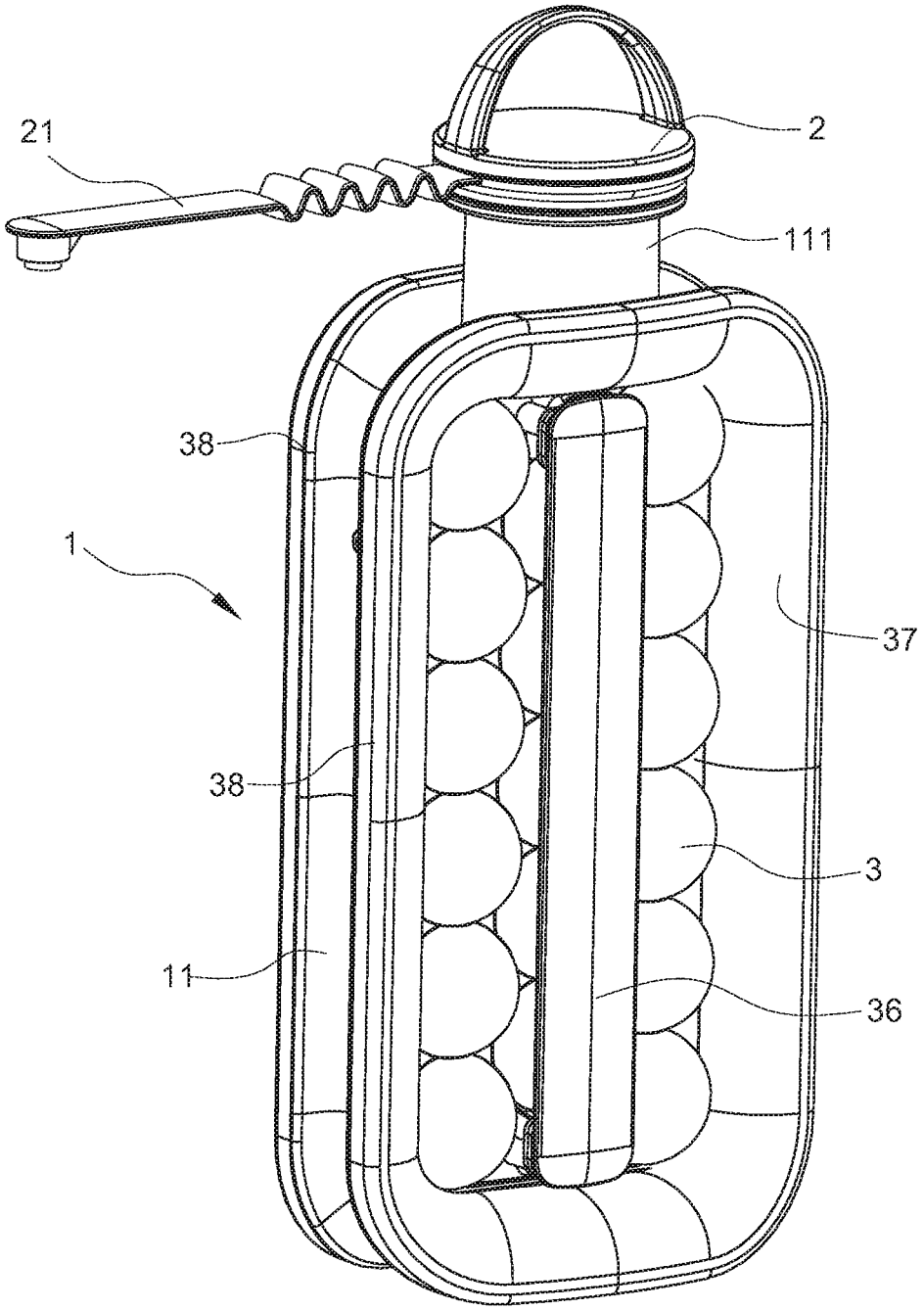
FIG. 1 is a perspective view of a bottle according to an embodiment of the present invention (at the closed state)

The present invention will be further described below in detail with reference to the accompanying drawings by embodiments.

FIGS. 1 to 7 show a preferred embodiment of the present invention.

A bottle with an ice cube mould comprises a bottle body 1 with a neck 111, and a lid 2 disposed on the neck 111.

The bottle body 1 has an annular peripheral frame 11, two ice-making plates 3 opposite with each other and two flexible connection wall 37;

the neck 111 is disposed on the top of the peripheral frame 11, and the neck 111 protrudes upward.

Each ice-making plates 3 has a plurality of recesses 31, and each recess 31 on one ice-making plates 3 faces to the corresponding recess on another ice-making plate 3, the recesses 31 on each ice-making plate 3 are arranged in several spaced-apart rows, with a plurality of spaced-apart recesses 31 up and down in each row. In this embodiment, the recesses 31 are half-spherical, and each ice cube made finally is roughly spherical.

Both the ice-making plates 3 are capable of moving forward and backward relative to each other, that is, each ice-making plate 3 can move forward and backward relative to the frame 11. The two ice-making plates 3 moving close and facing each other is defined as a closed state, the two ice-making plates 3 moving far away and spaced apart from each other is defined as an opened state. Because of the deformation performance of the flexible connection wall 37, the bottle body 1 can close or open at the forward and backward direction, so as to change the volume of the inner space of the bottle body 1 (becoming smaller or bigger), and during the opening and closing process of the bottle body 1, the bottle body 1 is always in a seal state.

When the two ice-making plates 3 are at the closed state, two recesses 31 on the two ice-making plates 3 facing each other form an ice-making space, a water inlet 32 in communication with the neck 111 is formed on between the two ice-making plates 3, and a water flow channel for guiding water coming from the water inlet 32 to the ice-making space is formed between the two ice-making plates 3.

When the two ice-making plates 3 are at the opened state, a chamber A of the bottle body 1 is defined between the two ice-making plates 3, in this moment, the volume of the chamber A is larger than that of the ice-making space, and ice cubes formed inside the recesses can depart from the ice-making plates 3 and drop into the chamber A of the bottle body 1.

The water flow channel comprises a recessed upper water chamber 33 formed in a top of the ice-making plate 3 and a recessed lower water chamber 35 formed in a bottom of the ice-making plate 3.

Wherein, multiple connecting channels 34 are disposed between the upper water chamber 33 and the recess 31 below the upper water chamber 33, and between adjacent two recesses 31 in each row to be communicated up and down, and between the lower water chamber 35 and the recess 31 above the lower water chamber 35. The upper water chamber 33 is communicated with the neck 111 through the water inlet 32, each ice-making plate 3 has multiple connecting channels 34 between the upper water chamber 33 and the topmost recess 31 in each row, and between adjacent two recesses 31 in each row to be communicated up and down. Each ice-making plate 3 has a connecting channel 34 between the lower water chamber 35 and the bottommost recess 31 in each row to be communicated up and down.

Each ice-making plate 3 has a gap 321 on the top of the ice-making plate 3, which is communicated with the upper water chamber 33, when the two ice-making plates 3 are at a closed state, the two gaps 321 together form the water inlet 32.

Each ice-making plate 3 has a handle 36 disposed on an external surface of the ice-making plate 3, for pulling the ice-making plate 3 outward.

The bottle body 1 in this embodiment has an annular peripheral frame 11 with two sides. The neck 111 is disposed on the top of the peripheral frame 11; the peripheral frame 11 surrounds the two ice-making plates 3, the edge of each ice-making plate 3 is connected to the peripheral frame 11 by a flexible connection wall 37.

The peripheral frame 11 may be made of plastic, to ensure that the bottle body 1 has enough strength. The peripheral frame 11 surrounds the two ice-making plates 3. The ice-making plates 3 are hard because they are made of plastic.

Each ice-making plate 3 and each flexible connection wall 37 are molded together by secondary injection molding; and a connection ring 38 made of plastic is connected with the outer edge of each flexible connection wall 37 by secondary injection molding, each connection ring 38 and the edge of each side of the peripheral frame 11 are sealed connected with each other. An annular slot 381 is formed on the connection ring 38. An annular rib 112 is arranged on an end face of the peripheral frame 11. The rib 112 is clamped into the slot 381.

The lid 2 is connected to the surface of the peripheral frame 11 via a connection strip 21. The lid 2 is stuffed into the neck 111 and fully fills the neck 111.

The working process of the bottle is described below.

Figure 2:
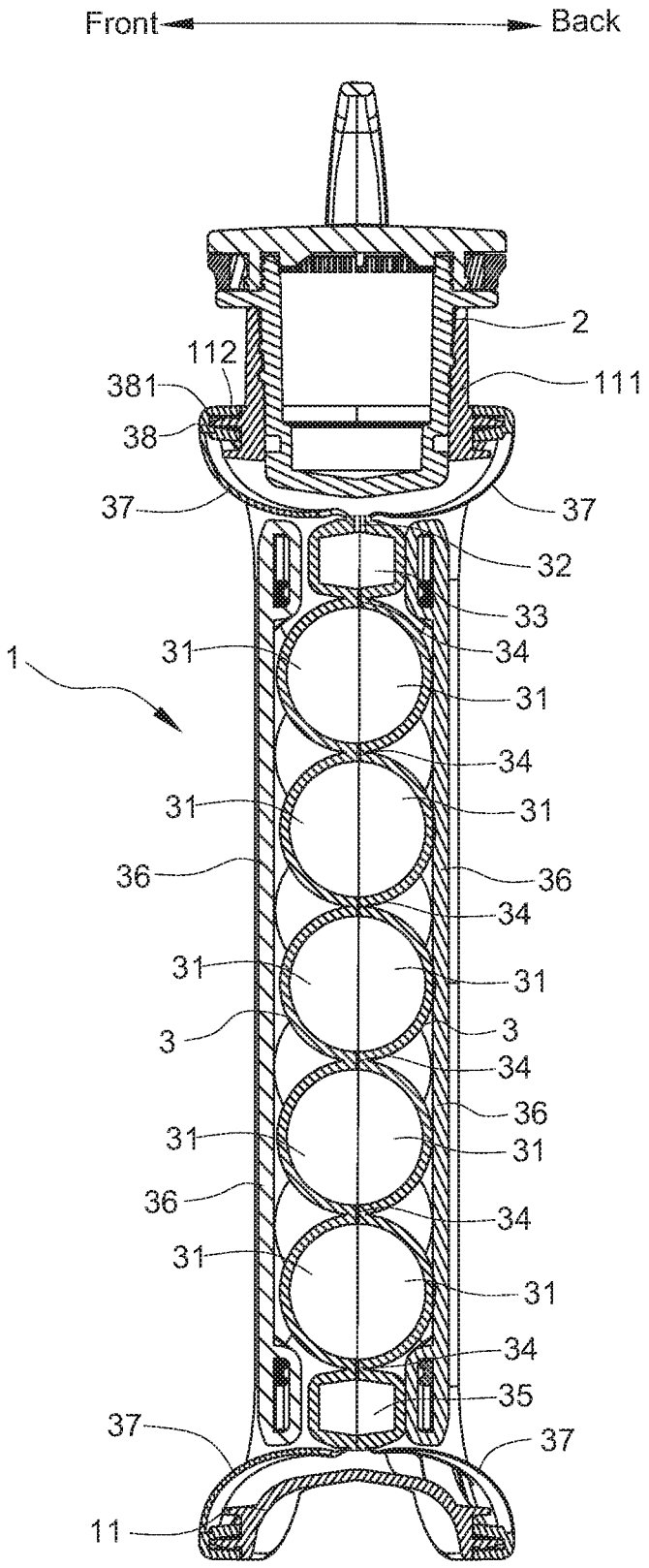
FIG. 2 is a sectional view of the bottle according to the embodiment of the present invention (at the closed state)

During ice-making, moving the two ice-making plates 3 to be faced each other and be kept in the closed state, and pouring water into the neck 111. The water will flow from the water inlet 32 and the water flow channel into the ice-making space. Then, putting on the lid 2. The lid 2 is stuffed into the neck 111 and fully fills the neck 111, to ensure no water in the neck 111, as shown in FIGS. 1 and 2. Putting the bottle into a freezer compartment of a refrigerator.

Figure 3:
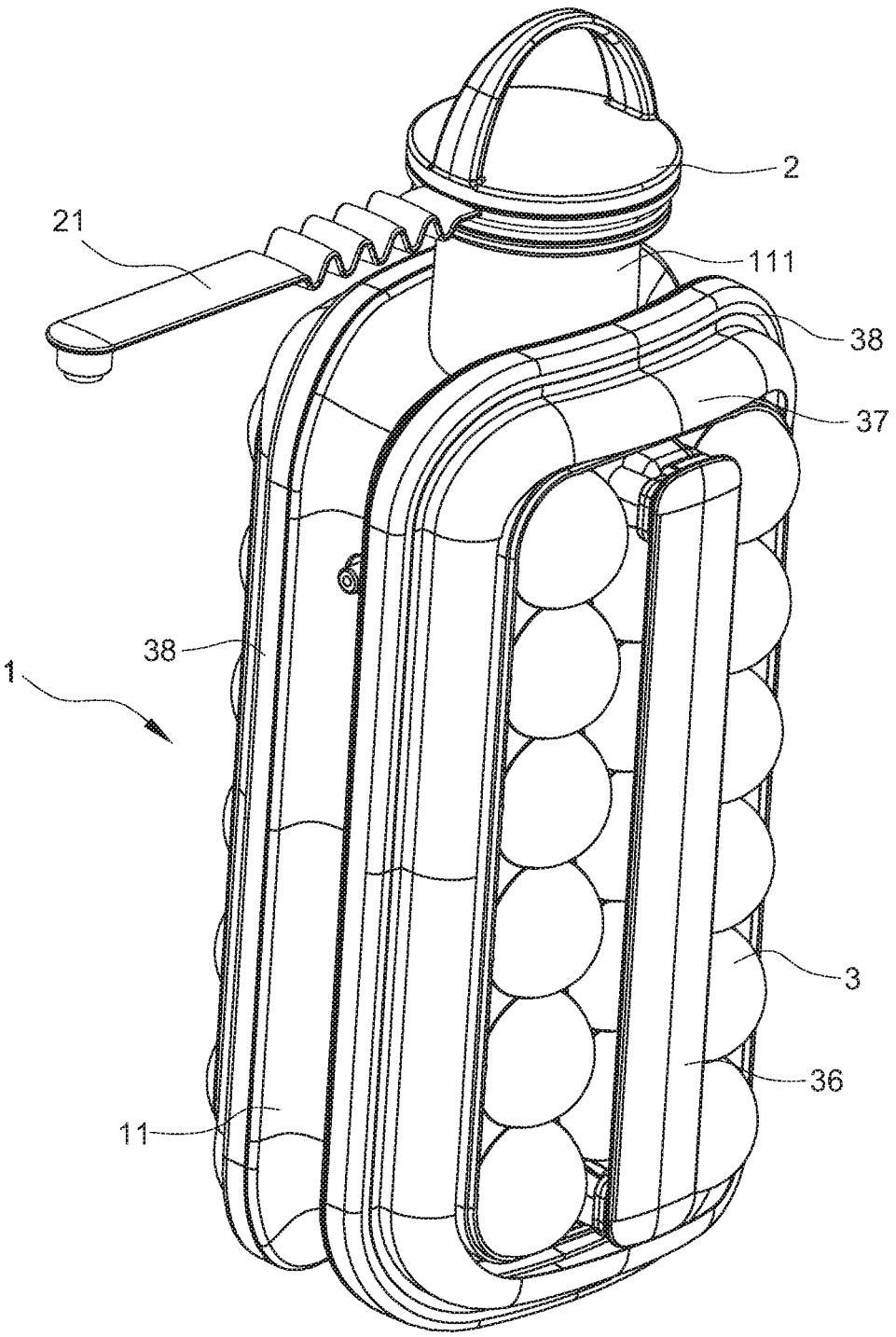
FIG. 3 is a perspective view of the bottle according to the embodiment of the present invention (at the opened state)
Figure 7:
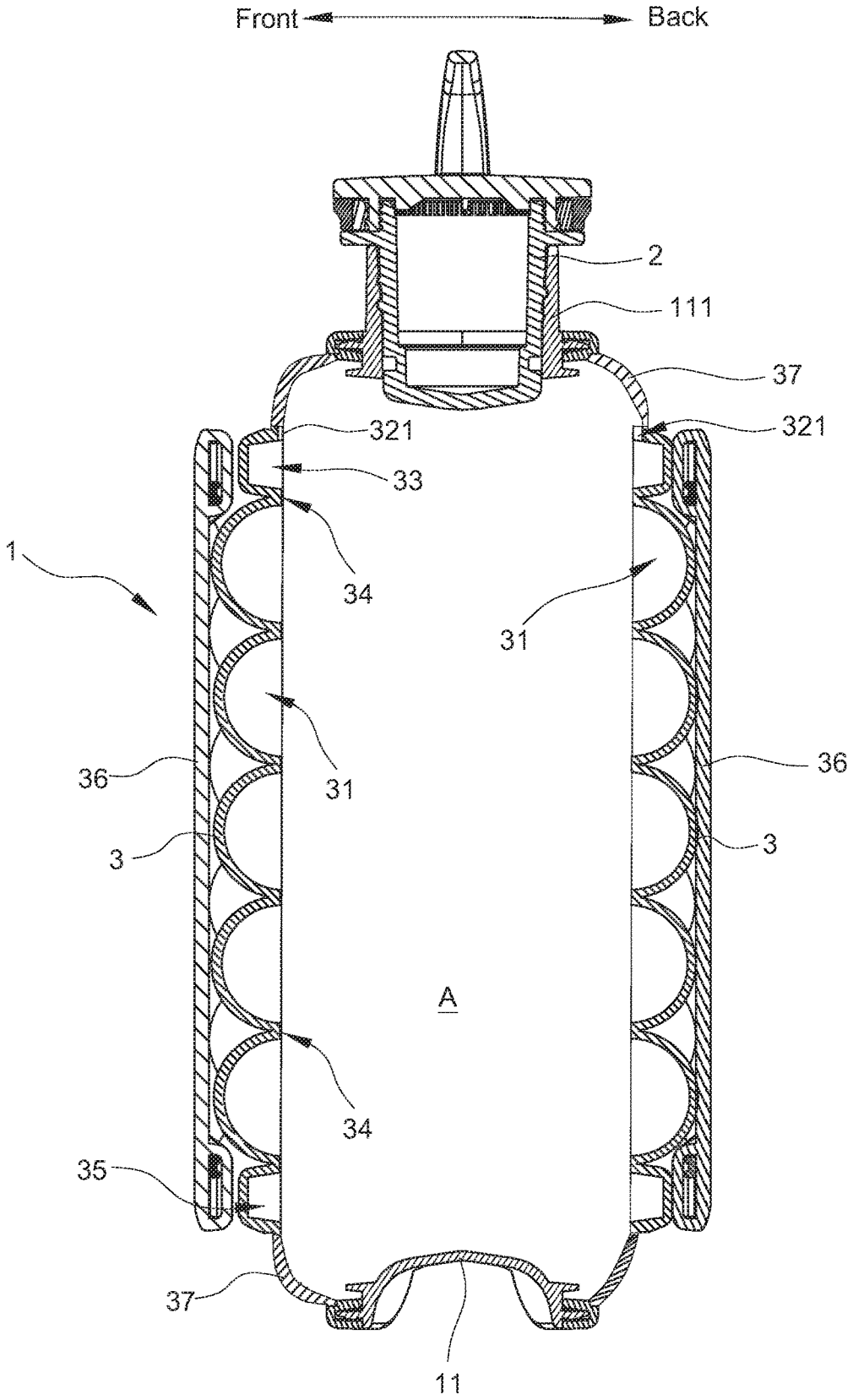
FIG. 7 is a sectional view of according to the embodiment of the present invention (at the opened state).

After the water in the ice-making spaces freezes, putting out the bottle. Holding the handle 36 on the two ice-making plates 3 and pulling outward to make the two ice-making plates 3 separate with each other. The chamber A inside the bottle body 1 is defined between the two ice-making plates 3, and ice cubes formed inside the ice-making space (all of the recesses) can depart from the ice-making plates 3 and drop into the chamber A inside the bottle body 1, as shown in FIGS. 3 and 7.

Figure 4:
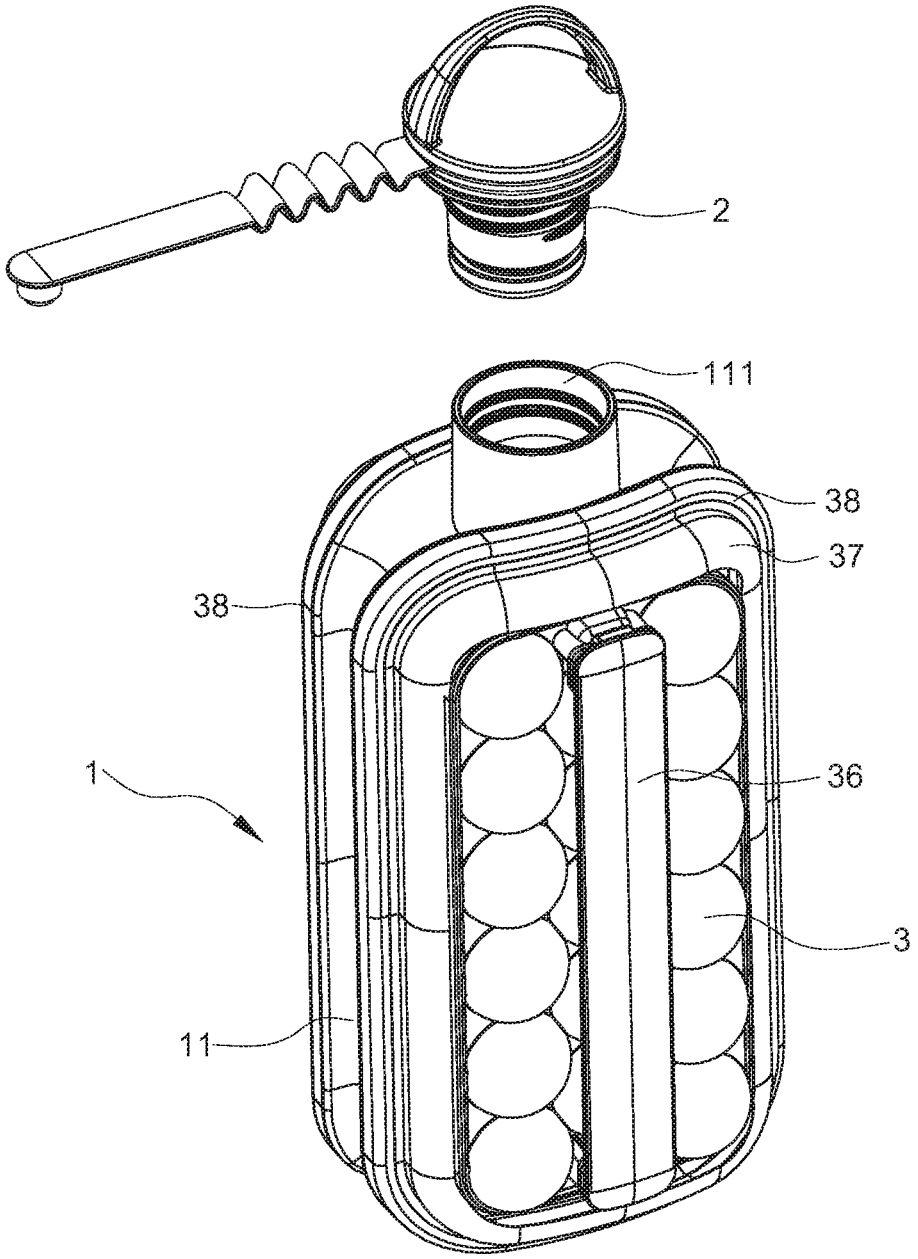
FIG. 4 is a perspective view of the bottle according to the embodiment of the present invention (at a state when ice cubes can be poured out or being used as a common bottle)
Figure 5:
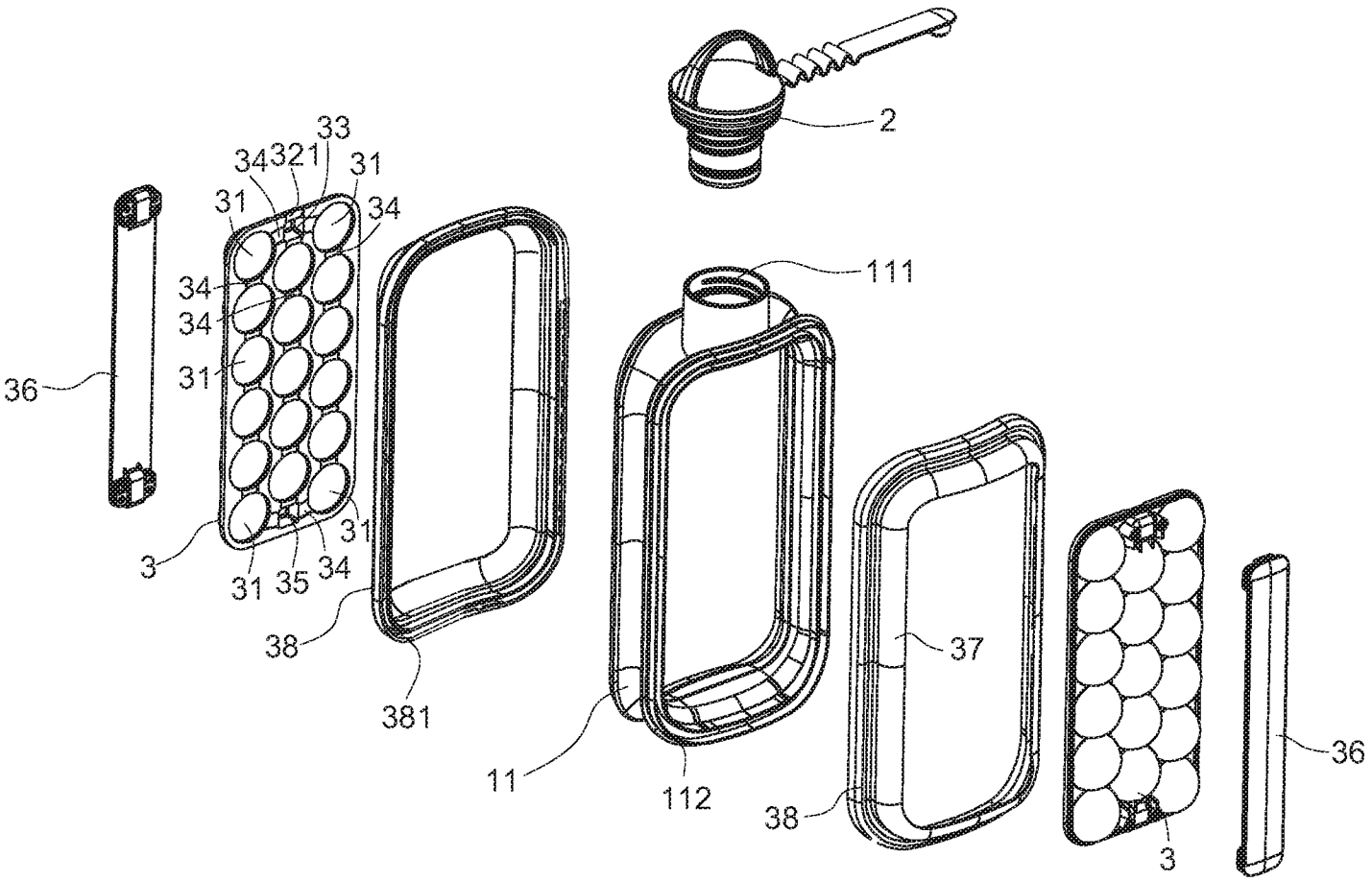
FIG. 5 is a exploded view of the bottle according to the embodiment of the present invention.
Figure 6:
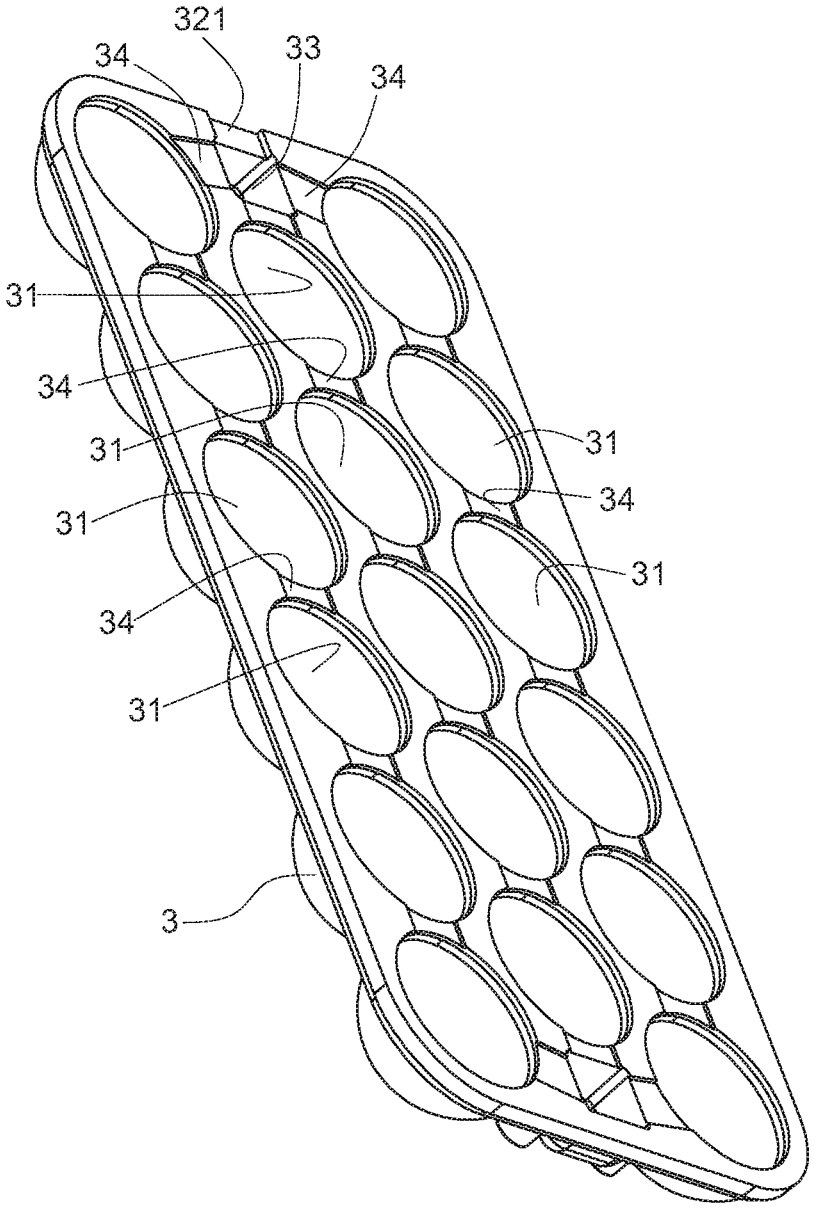
FIG. 6 is a perspective view of the ice-making plate according to the embodiment of the present invention.

The ice cubes can be poured into a cup from the neck 111. Or drinks can be directly injected into the bottle to make iced drinks, the user can drink directly by the neck, as shown in FIG. 4.

It is to be noted that, in the description of this embodiment, orientations or location relationships indicated by terms such as "front, behind", "left, right", "upper, lower" are the orientations and location relationships illustrated on the basis of the accompany drawings. Such terms are used just for ease of describing the present invention and simplifying the description, and it is not indicated or implied that the stated device or element must have a specific orientation or must be constructed and operated in the specific orientation, and shall not be interpreted as any limitation to the present invention. Terms "mounted", "connected to" and "connected with" should be understood in a broad sense. For example, the connection may be fixed connection or detachable connection or integral connection. The connection may be direct connection, or indirect connection with a mediator therebetween. The connection may be the communication between two elements. For a person of ordinary skill in the art, the specific meaning of the aforementioned terms in the present invention can be understood in specific circumstances.

The invention claimed is:

1. A bottle with an ice cube mould, comprising:

a bottle body with a neck;

a lid disposed on the neck;

wherein, the bottle body has two ice-making plates opposite with each other, at least one of the two ice-making plates has a plurality of recesses, at least one of the two ice-making plates has a handle disposed on an external surface of the ice-making plate for pulling the ice-making plate outward; and the two ice-making plates are capable of moving relative to each other, the two ice-making plates facing each other is defined as a closed state, the two ice-making plates spaced apart from each other is defined as an opened state;

when the two ice-making plates are at the closed state, two recesses facing each other form an ice-making space, a water inlet in communication with the neck is formed on between the two ice-making plates, and a water flow channel for guiding water coming from the water inlet to the ice-making space is formed between the two ice-making plates;

when the two ice-making plates are at the opened state, a chamber of the bottle body is defined between the two ice-making plates, and ice cubes formed inside the recesses drop into the chamber of the bottle body.

2. The bottle of claim 1, wherein each ice-making plate has a plurality of recesses, and each recess on one ice-making plates faces to the corresponding recess on another ice-making plate;

when the two ice-making plates are at the closed state, the recess on one ice-making plate and the corresponding recess on another ice-making plate form the ice-making space.

3. The bottle of claim 2, wherein the recesses on each ice-making plate are arranged in several spaced-apart rows, with a plurality of spaced-apart recesses up and down in each row;

the water flow channel comprises a recessed upper water chamber formed in a top of the ice-making plate; and the upper water chamber is communicated with the neck, each ice-making plate has multiple connecting channels between the upper water chamber and the topmost recess in each row, and between adjacent two recesses in each row to be communicated up and down.

4. The bottle of claim 3, wherein the water flow channel further comprises a recessed lower water chamber formed in a bottom of the ice-making plate; and each ice-making plate has a connecting channel between the lower water chamber and the bottommost recess in each row to be communicated up and down.

5. The bottle of claim 3, wherein each ice-making plate has a gap on the top of the ice-making plate, which is communicated with the upper water chamber, when the two ice-making plates are at a closed state, the two gaps together form the water inlet.

6. The bottle of claim 1, wherein the bottle body has an annular peripheral frame with two sides, the neck is disposed on the top of the peripheral frame;

the peripheral frame surrounds the two ice-making plates, the edge of each ice-making plate is connected to the peripheral frame by a flexible connection wall.

7. The bottle of claim 6, wherein each ice-making plate and each flexible connection wall are molded together by secondary injection molding; and a connection ring made of plastic is connected with the outer edge of each flexible connection wall by secondary injection molding, each connection ring and the edge of each side of the peripheral frame are sealed connected with each other.

8. The bottle of claim 6, wherein the lid is connected to the surface of the peripheral frame via a connection strip.

9. The bottle of claim 1, wherein the neck protrudes upward, and the lid is stuffed into the neck and fully fills the neck.

* * * * *